US005155975A

United States Patent [19]

Knowler

[11] Patent Number: 5,155,975

[45] Date of Patent: Oct. 20, 1992

[54] SHREDDER/COMPACTOR ASSEMBLY FOR RECYCLING WASTE MATERIAL

[75] Inventor: James T. Knowler, Calary, Canada

[73] Assignee: Solid Waste Systems (1990) Inc., Airdrire, Canada

[21] Appl. No.: 707,500

[22] Filed: May 30, 1991

[51] Int. Cl.[5] ..... B65B 63/00

[52] U.S. Cl. ..... 53/513; 53/527; 53/249; 241/37.5; 241/100; 241/239; 241/241; 241/243; 141/80; 141/272

[58] Field of Search ..... 53/513, 527, 570, 249; 141/71, 80, 166, 114, 271, 272, 314, 316, 377; 241/37.5, 100, 239, 241, 243

[56] References Cited

U.S. PATENT DOCUMENTS

| | | | |
|---|---|---|---|
| 2,747,353 | 5/1956 | Shibata | 53/249 |
| 3,502,119 | 3/1970 | Sweeney | 141/314 |
| 3,703,970 | 11/1972 | Benson | 241/241 |
| 3,861,117 | 1/1975 | Defilippi | 53/527 |
| 3,873,035 | 3/1975 | Benson | 241/241 X |
| 4,140,284 | 2/1979 | Jöbkes | 241/241 X |
| 4,524,916 | 6/1985 | Keyes et al. | 241/243 X |
| 4,872,493 | 10/1989 | Everman | 141/80 X |

*Primary Examiner*—John Sipos
*Assistant Examiner*—Linda B. Johnson
*Attorney, Agent, or Firm*—Sheridan, Ross & McIntosh

[57] ABSTRACT

A fabric bag is used to be packed with shredded waste material from a shredder/compactor. During loading, the bag is confined in a close-fitting steel box and is supported on a fork lift-type ballast. Use of the box as a confining rigid jacket enables the shredder/compactor to compress and compact the shredded feed. The front wall of the box can then be removed and a fork lift-type jack used to extract the packed bag and pallet as a unit, ready for shipping.

4 Claims, 13 Drawing Sheets

OPERATOR PREPARES BAG

OPERATOR PLACES BAG ON PALLET IN RETAINER BIN

OPERATOR CLOSES AND SECURES BIN DOOR

OPERATOR PUMPS UP RETAINER BIN

RETAINER BIN TILTED AT ABOUT 22°

OPERATOR LOADS MATERIAL WHICH IS THEN SHREDDED INTO BIN

LOWERING RETAINER BIN

REMOVE FULL BAG WITH PALLET JACK

SHREDDER/COMPACTOR ASSEMBLY FOR RECYCLING WASTE MATERIAL

FIELD OF THE INVENTION

This invention relates to an improved assembly for shredding, compacting, bagging and shipping waste material (such as plastic and glass bottles, cans, cardboard, paper and the like).

BACKGROUND OF THE INVENTION

The present invention has to do with modification of a known assembly for shredding waste material and compacting it into a receptacle. Such a system incorporates a machine known as a shredder/compactor. One such machine, preferred in connection with the present invention, is disclosed in U.S. Pat. No. 3,703,970, issued Nov. 28, 1972, to R. R. Benson. The disclosure of the patent is incorporated herein by reference.

The Benson machine has heretofore been manufactured and supplied commercially by the present assignee.

The machine is adapted to shred or break up waste material and to feed the shredded material into a receptacle, usually a large steel box. When the box begins to fill, the machine acts to force-feed even more material into it, thereby compacting the box contents into a dense form.

The shredder/compactor machine in combination with the receptacle means together form the "assembly" referred to above.

The assembly is commonly used, for example, with apartment buildings and restaurants, to shred and compact their commingled waste mixture into steel boxes. The Benson machine is capable of reducing the volume of the waste material by a factor of about 7:1. The filled boxes are periodically emptied into a compactor-type garbage disposal truck. This truck further compacts the waste with a hydraulic ram and then delivers it to a dump site.

It will be noted that, in this prior system, the shredder/compactor is fed a non-sorted mixture comprising articles and waste products formed of different materials.

In recent times, recycling of waste materials has manifested itself in commercial operations. However, each recycler is usually limited by his equipment to processing only one type of waste material.

This fact has obliged the waste handlers supplying the recyclers to sort the waste into distinct lots, each such lot 12 containing only material of a certain type. These lots then have to be separately shipped to different recyclers. In other words, the shredded aluminum cans go to one recycler and the shredded glass to another.

At this point it is appropriate to describe in a general way the Benson shredder/compactor machine. It comprises an elevated, rectangular frame supported at its corners by legs. There is room to insert the receptacle between the legs and beneath the frame. The frame includes a generally rectangular tubular member forming a central, vertical, open-ended throat or passageway. A hopper feeds waste material to the inlet of this passageway. A rotatable, driven, toothed shaft ("rotor") is mounted to one pair of opposed side walls of the tubular member. The rotor thus centrally traverses the passageway adjacent its lower end. The rotor teeth are formed of steel plate and extend outwardly from the shaft in spaced relation along its length. The rotor is capable of high torque, being driven by a motor through reduction gearing. One of the tubular member walls ("the anvil wall"), extending parallel to the rotor, carries an array of spaced-apart anvil members. These anvil members are steel plates, each having a configuration something like that of a ski jump. The anvil members are positioned so that the rotor teeth will mesh with and pass down between them with some clearance. There is also some clearance between the shaft and the anvil members. The turning rotor teeth thus act to trap waste items against the anvil members and slice through them on their downward entry into the anvil gaps. They simultaneously force comminuted material ahead of them through the gap between the shaft and the anvil members and through the gaps between said anvil members. As a result, the shredded bits and pieces are force-fed by the rotor into the receptacle. Projecting from the tubular member wall opposite to the anvil wall is an array of spaced-apart stripper members. These stripper members are also steel plates positioned to mesh with the rotor teeth and having close clearances with said teeth. The stripper members are operative to strip waste material, still clinging to the rotor teeth, as the teeth rotate upwardly therethrough. This stripped material drops into the receptacle.

It needs to be noted that the rotor teeth project downwardly beneath the lower outlet of the tubular member and extend into the mouth of the receptacle, when the teeth are in the lowermost portion of their rotational travel and the receptacle is in close engagement with the underside of the frame. When the receptacle is full, the teeth act to drive the top layer of waste material downwardly and in the direction of rotation, at an angle of about 22° relative to horizontal. As a result, the box contents are compressed and compacted. For this compression to happen, the receptacle necessarily has to rigidly confine the waste materials. Thus there is used a closed box formed of steel plate, said box having a top wall with an opening which corresponds with the outlet of the tubular member. The box, usually mounted on castors, is designed to fit snugly to the undersurface of the frame, thereby providing a seal to effectively prevent the escape of waste material.

The rotor is formed with only two teeth in a vertical plane, said teeth being generally diametrically aligned. Thus there are two "flat" spots on each side of the shaft. The rotor is positioned with its teeth in a horizontal plane to enable the box to be inserted or removed.

The prior system, as described, was characterized by a singular problem when offered to waste handlers supplying recyclers. The heavy steel box was inappropriate as a shipping container to deliver the shredded waste lot to a recycler, who might be located in a different city.

SUMMARY OF THE INVENTION

The invention is based on using a collapsible foldable flexible bag, (preferably formed of woven polypropylene) as the receptacle for receiving the shredded waste.

The bag is generally rectangular and box-like in form and has a top wall forming an opening for receiving shredded waste material. It is used in conjunction with a close-fitting open-topped rigid box which acts to confine the bag along its side surfaces during filling. The walls of the box are essentially non-apertured, so that the bag cannot bulge out through them. The box has a removable front wall to enable insertion and removal of the bag and a pallet supporting it. The box has means for suspending the bag in an erect and open condition, ready for filling. As stated, the bag is supported in the box on a removable pallet, preferably a wooden pallet adapted to be handled with a fork-lift jack. The box preferentially has side walls which diverge outwardly from the rear to the front, whereby the bulging bag and pallet can more easily be extracted from the box when the bag is filled. Preferably the box is hinged at its upper rear end to the shredder/compactor and has a triangular lip extending up from its rear upper portion. A cylinder connects the box and shredder-compactor, for pivoting the box forwardly about its hinge means. Thus the box and contained bag can be raised and tilted so that the triangular lip comes into close sealing engagement with the underside of the shredder/compactor, with the base of the bag ending up disposed generally perpendicularly to the direction of movement of the shredded material being fed into the bag.

As a result of this design, the following ends are achieved:

- The bag is confined by the jacketing box, so that the shredded waste material can be compacted;
- Although the bag when loaded can weigh up to 2,000 pounds, it is already pallet-supported and thus extraction from the box can be handled with fork-lift means;
- Loading/extraction access is provided by use of a box end wall that is removable (which term is intended to cover an openable wall);
- The box/bag unit can preferably be raised into the filling position and lowered when the loaded bag is to be removed, so that the bag can clear the protruding rotor teeth during extraction;
- The box/bag unit can be tilted as aforesaid, which has been shown by testing to enable a greater extent of compaction to be achieved—stated otherwise, when the bag bottom is positioned generally perpendicular to the direction of shredded waste travel, compaction is maximized; and
- Most importantly, an assembly has been devised which enables use of a bag as the container and supplies a packed bag ready for shipping on a pallet, whereby on being emptied by the recycler the bag can be collapsed and folded and returned as a light compact package.

Broadly stated, the invention is an assembly for shredding waste material and packing it in the form of a palletized bagged unit ready for shipping, comprising: a shredder-compactor means comprising a hopper, a frame supporting the hopper, a generally rectangular, downwardly extending tubular member formed by the frame and being adapted to receive waste material from the hopper, said tubular member forming an open-ended passageway having an upper inlet and lower outlet, means for supporting the frame in an elevated position whereby receptacle means may be positioned beneath the bottom outlet of the tubular member, a driven rotatable rotor comprising a shaft carrying outwardly projecting, spaced apart teeth, said rotor extending transversely across the passageway and being mounted to a pair of first opposed side walls of the tubular member, said teeth being adapted to project downwardly beyond the lower outlet of the tubular member in the course of rotation, said tubular member carrying opposed spaced-apart anvil members and spaced-apart stripping members on the second opposed side walls of the tubular member, said anvil members and stripping members being adapted to mesh with and enable passage of the rotor teeth therebetween, said teeth and anvil members being operative, in the course of downward rotation of the teeth, to withdraw waste material out of the hopper, to shred it, and to bias it into the receptacle means, said stripping members being operative to strip residual shredded material clinging to the teeth as they rotate upwardly therethrough, said teeth further being operative to compact the shredded material in the receptacle means, as the latter becomes filled, in the course of rotating beneath the lower outlet of the tubular member; and receptacle means associated with the shredder-compactor means, said receptacle means comprising a rigid open-topped box having bottom and side walls and front and rear end walls, the front wall being removable and the bottom wall being integral with the side walls so that it is stationary, said side walls being essentially non-apertured, a collapsible foldable flexible bag suspended in the box, said bag having a generally rectangular and box-lie configuration and being sized to have a close fit with the box when opened and suspended therein, said bag forming an interior chamber and having a top wall which is partly opened only at one end to provide an opening communicating with the outlet of the tubular member, the closed portion of said top wall being operative to assist in containing the shredded material being compacted into the interior chamber and prevent its escape, means associated with the box for suspending the bag open and erect in the box, said bag being supported on a fork lift-type pallet positioned in the box, said bag top wall, box and frame cooperating to provide a seal around the bottom outlet of the tubular member to prevent the escape of waste material being fed into the bag by the shredder-compactor.

In another broad aspect, the invention extends to the combination of: a fork lift-type pallet; a generally rectangular, box-like bag formed of flexible material, such as woven polypropylene, said bag having bottom, side and top walls, the top wall being openable and having means for securing it closed; the bag being filled with compacted shredded waste; the bag being positioned on the pallet to provide a unit for shipping.

DESCRIPTION OF THE DRAWINGS

(a) the operator preparing the bag,
(b) the operator suspending the bag in the box on a pallet,
(c) the operator closing the door with the bag suspended, erect and opened, in the box,
(d) the operator actuating the hydraulic cylinders to raise the box to the loading position,
(e) the operator completing raising of the box,
(f) the operator loading the hopper,
(g) the operator lowering the box and filled bag, and
(h) the loaded bag and supporting pallet being removed by a pallet jack.

DESCRIPTION OF THE PREFERRED EMBODIMENT

Figure 1:
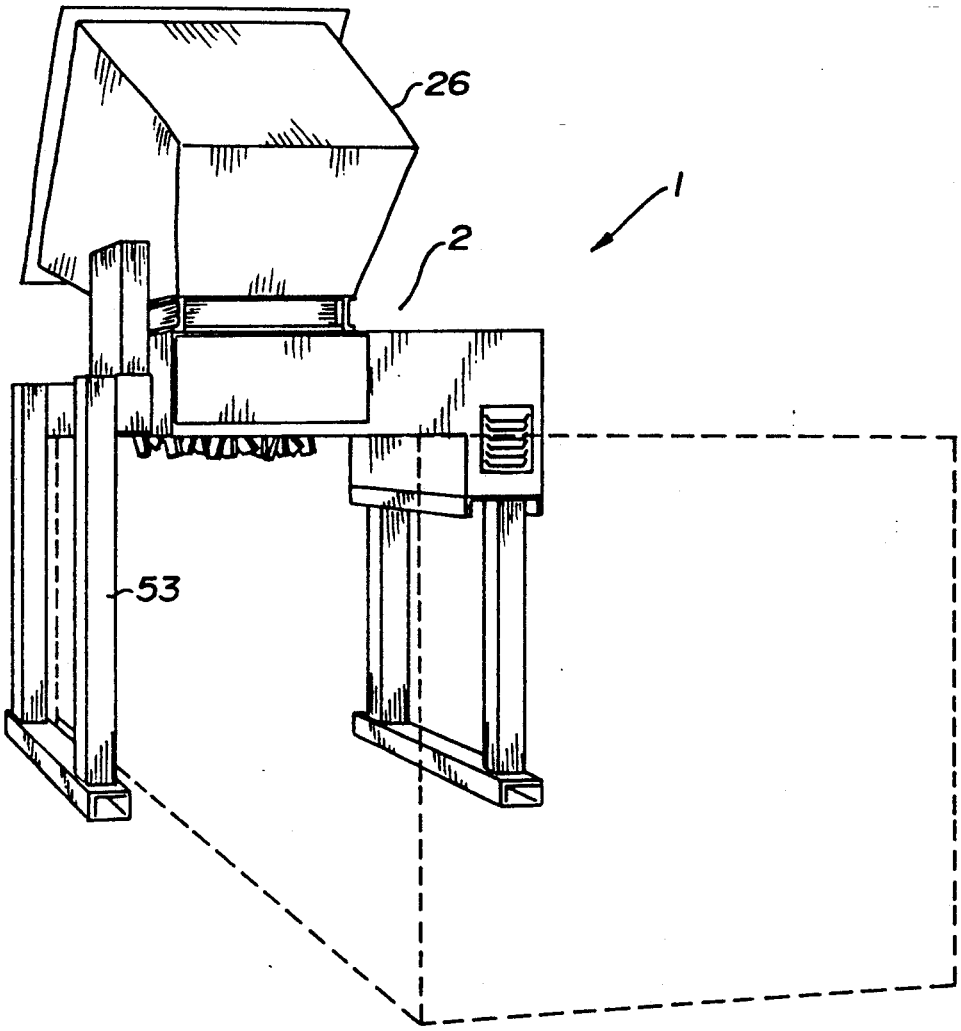
Fig. 1. PRIOR ART
FIG. 1 is a perspective view showing the known Benson-type shredder-compactor, with a prior art receptacle box shown in broken lines.
Figure 2:
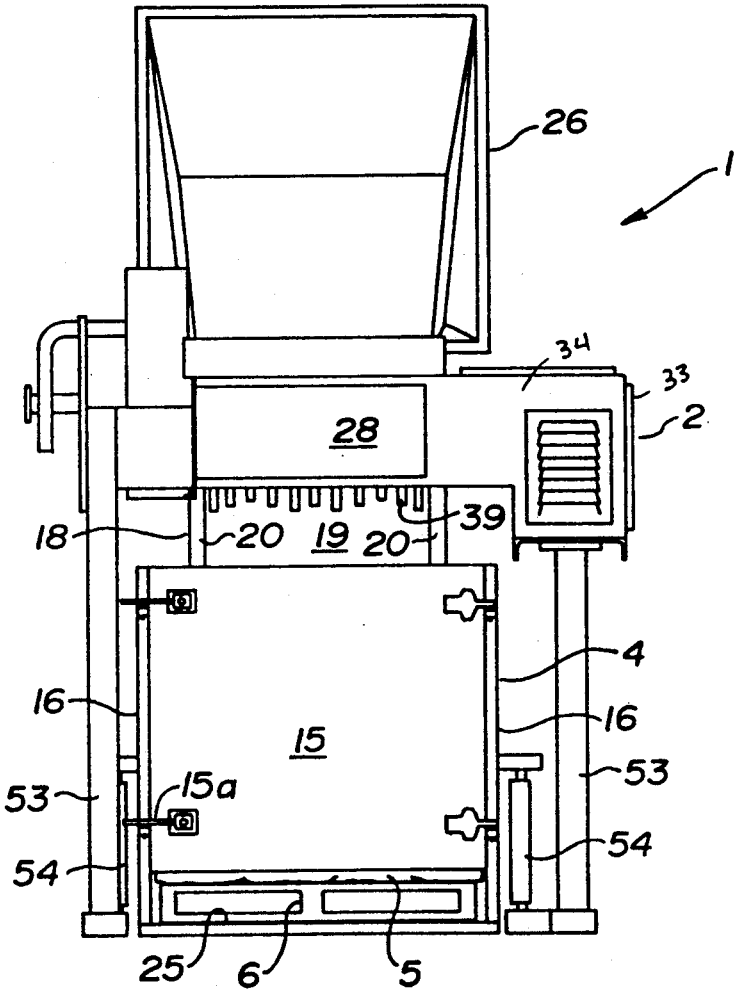
FIG. 2 is a front view showing the shredder-compactor and box with the box in the lowered position.
Figure 3:
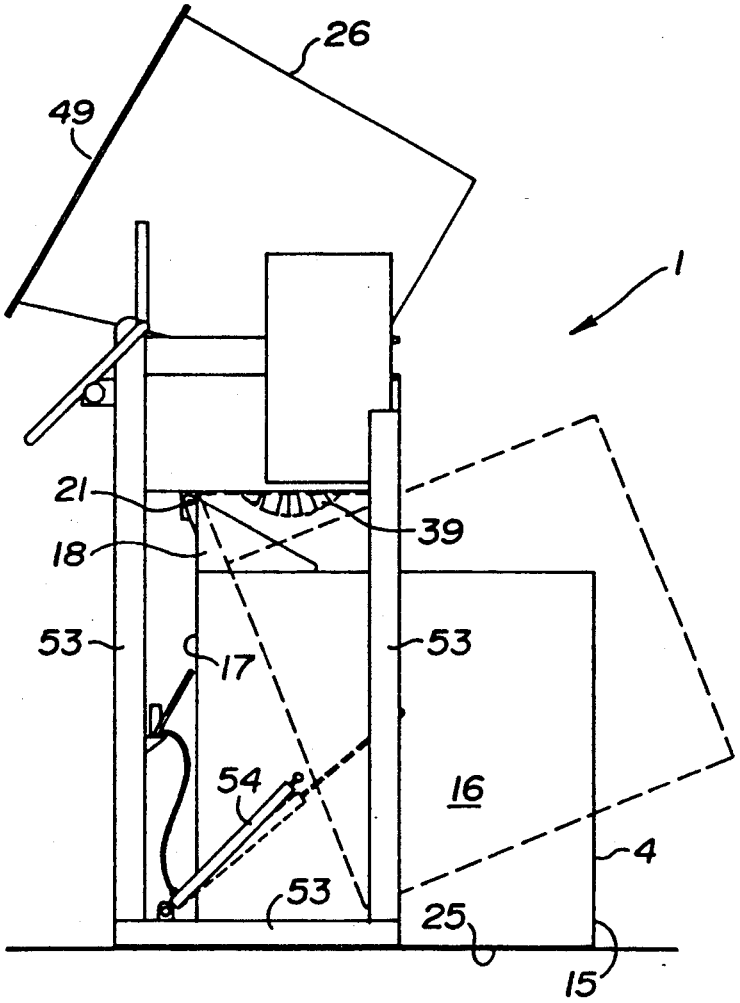
FIG. 3 is a side view showing the shredder-compactor and box with the box shown in the lowered position in unbroken lines and in the raised position in broken lines.
Figure 4:
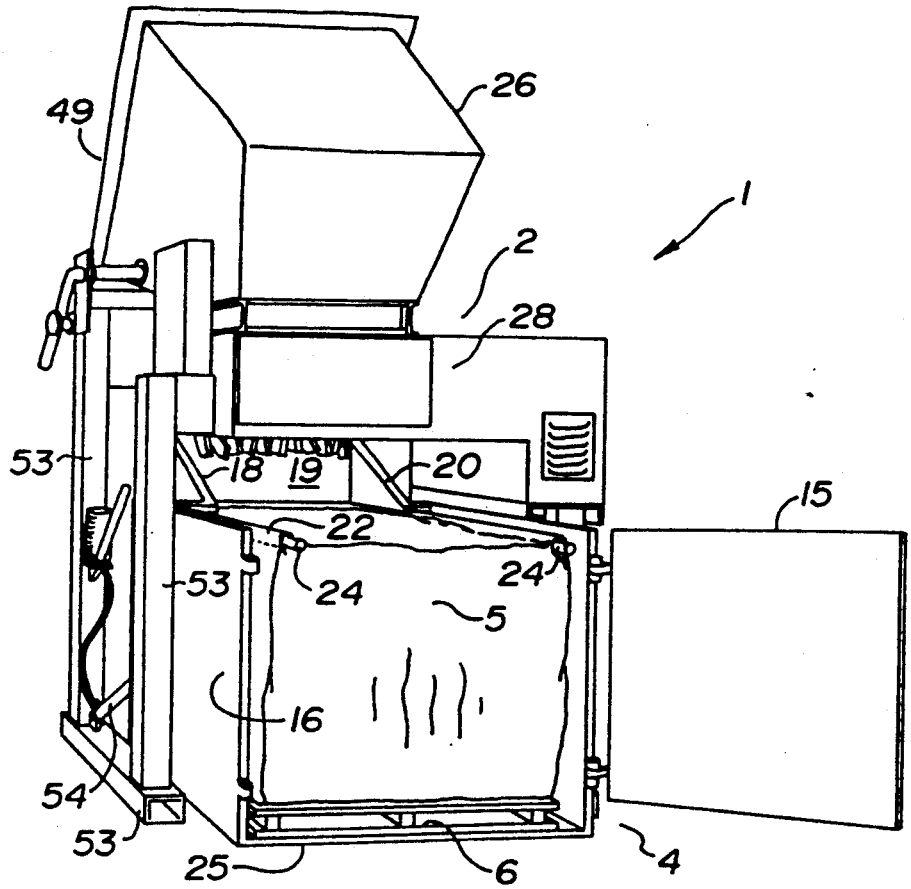
FIG. 4 is a perspective view showing the entire assembly with the box door open and the bag suspended open and erect in the box and supported by a pallet.
Figure 5:
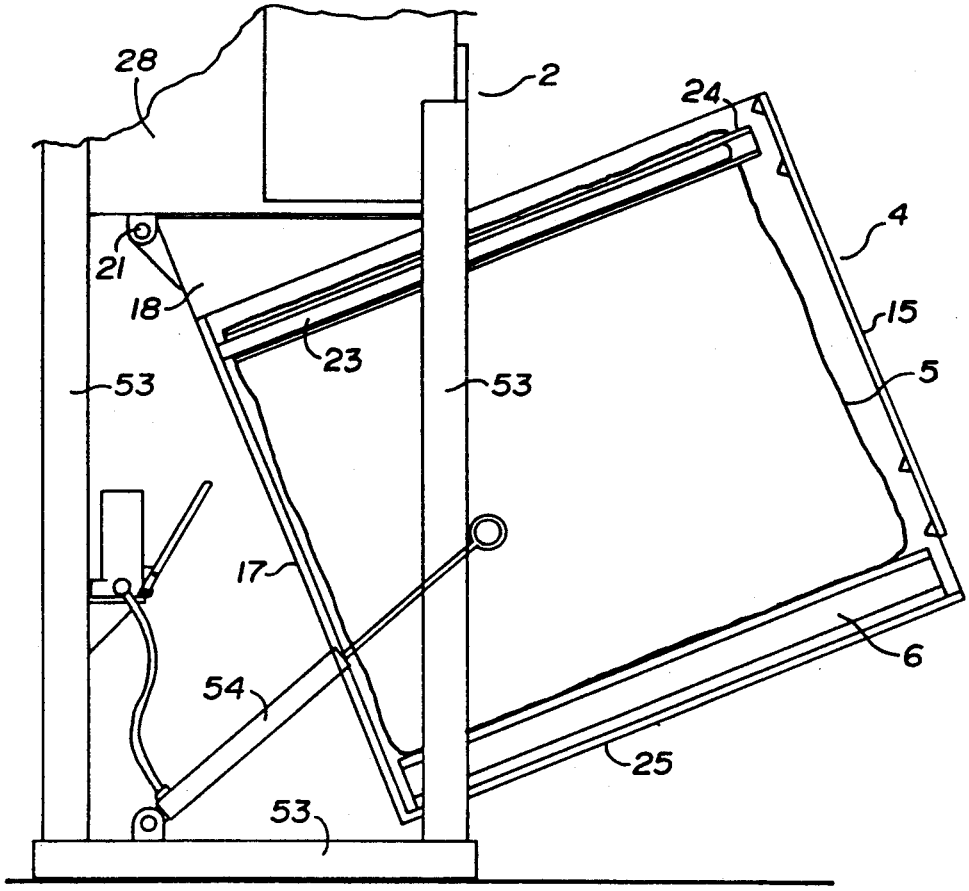
FIG. 5 is a side view, partly in section, of part of the assembly showing the box upraised and with the bag and pallet shown.
Figure 6:
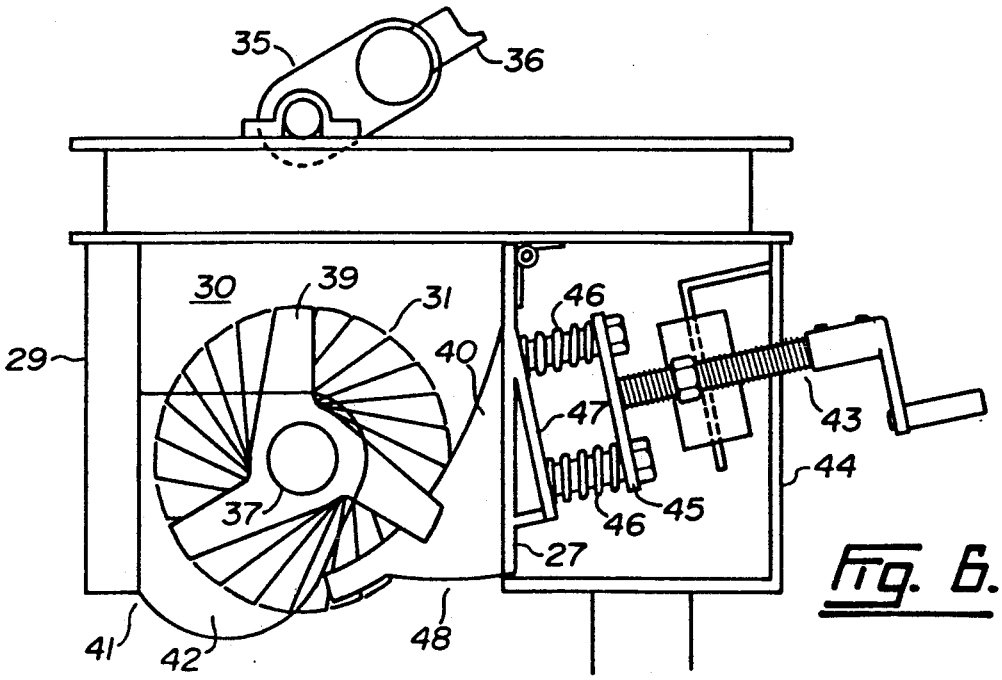
FIG. 6 is a side sectional view showing the tubular member, the means for locking and biasing the anvil wall and the rotor.
Figure 7:
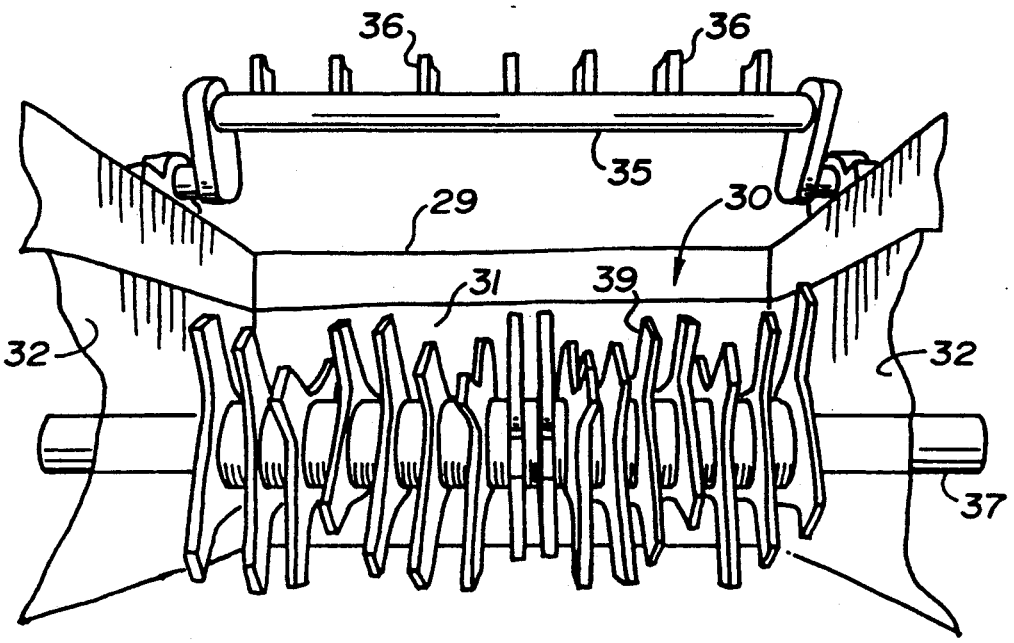
FIG. 7 is a front view showing part of the tubular member, the rotor and the claw bar.
Figure 8:
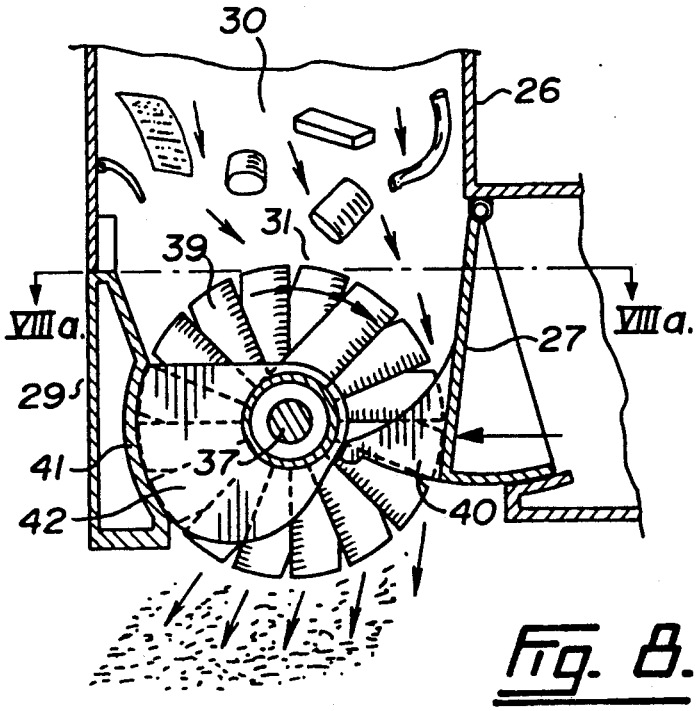
FIG. 8 is a side sectional view showing part of the hopper, the frame, the tubular member, the rotor, the anvil members, and the stripping members.
Figure 8A:
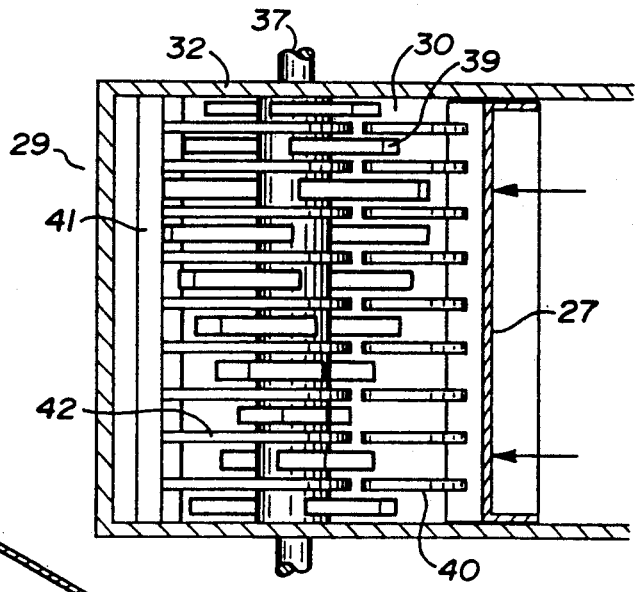
FIG. 8*a* is a top plan view showing the rotor, anvil stripping members.
Figure 9:
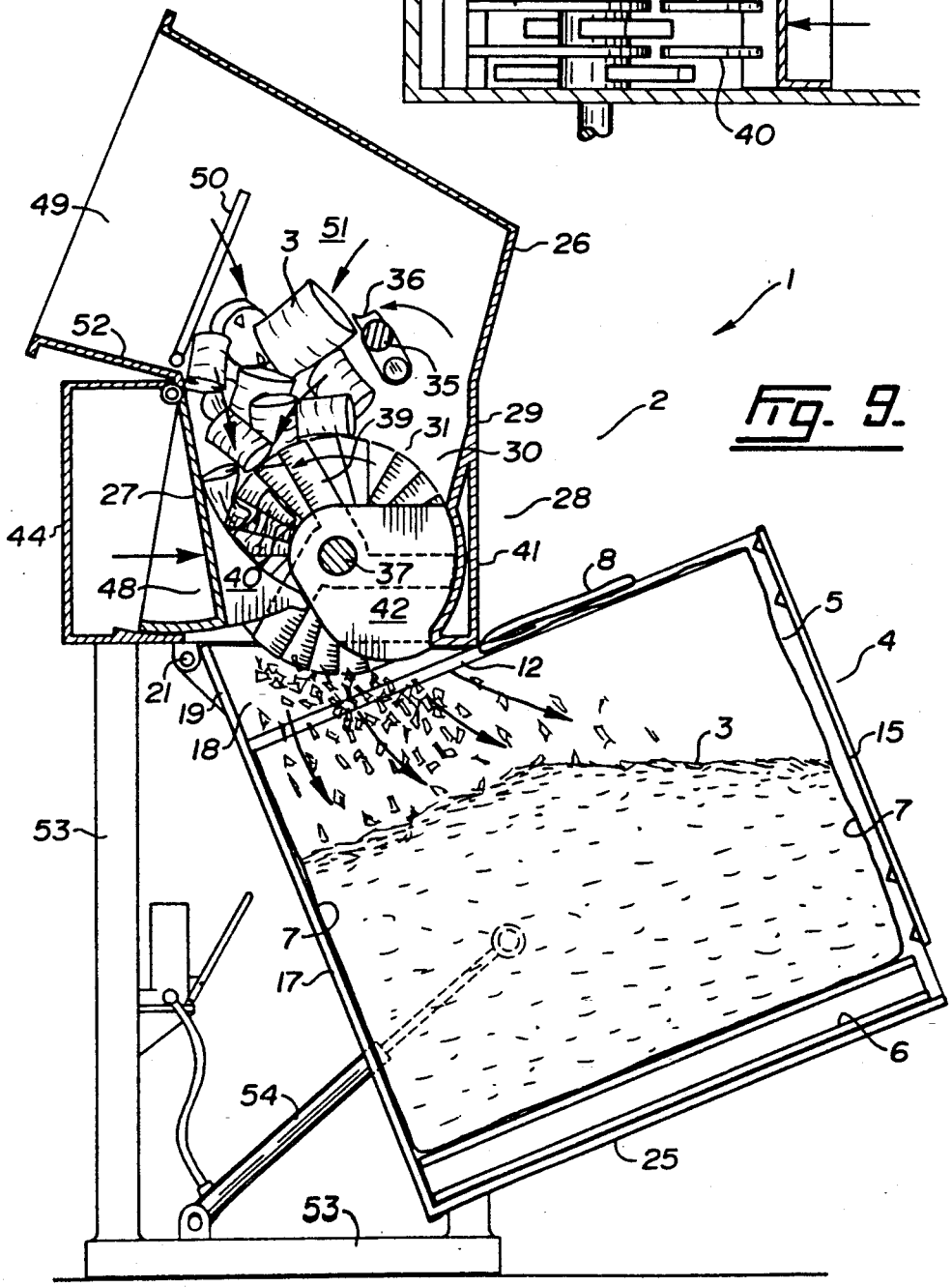
FIG. 9 is a partly sectional side view showing the entire assembly in the loading mode, with arrows indicating the flow of waste material.
Figure 10:
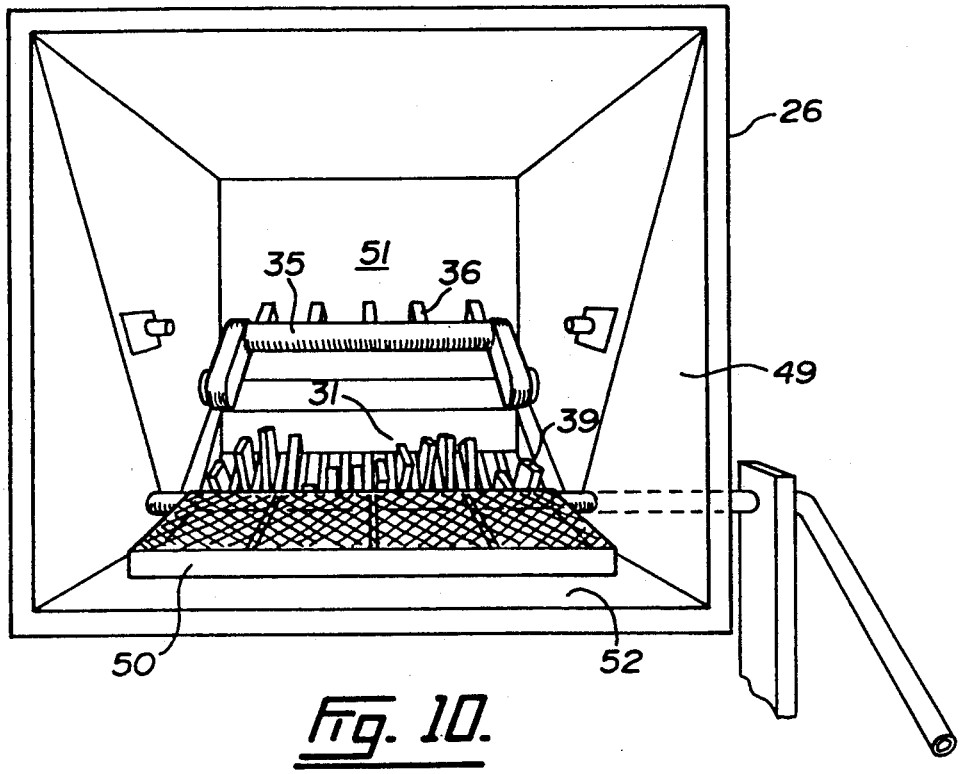
FIG. 10 is a front view of the hopper with the hopper gate down.
Figure 11:
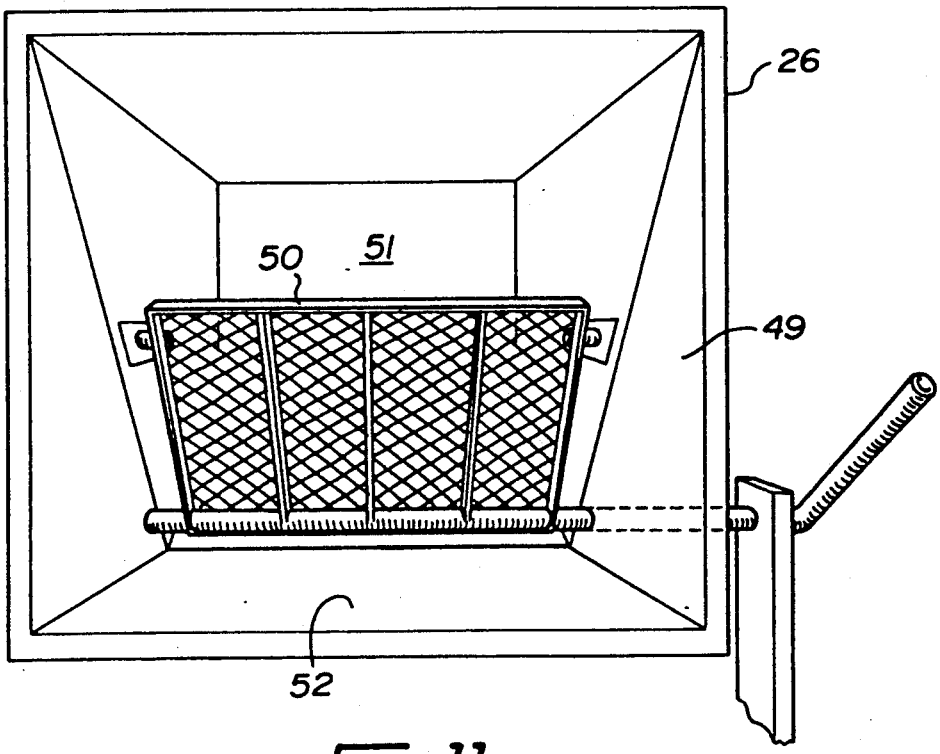
FIG. 11 is a view similar to FIG. 10 but with the gate up.
Figure 12:
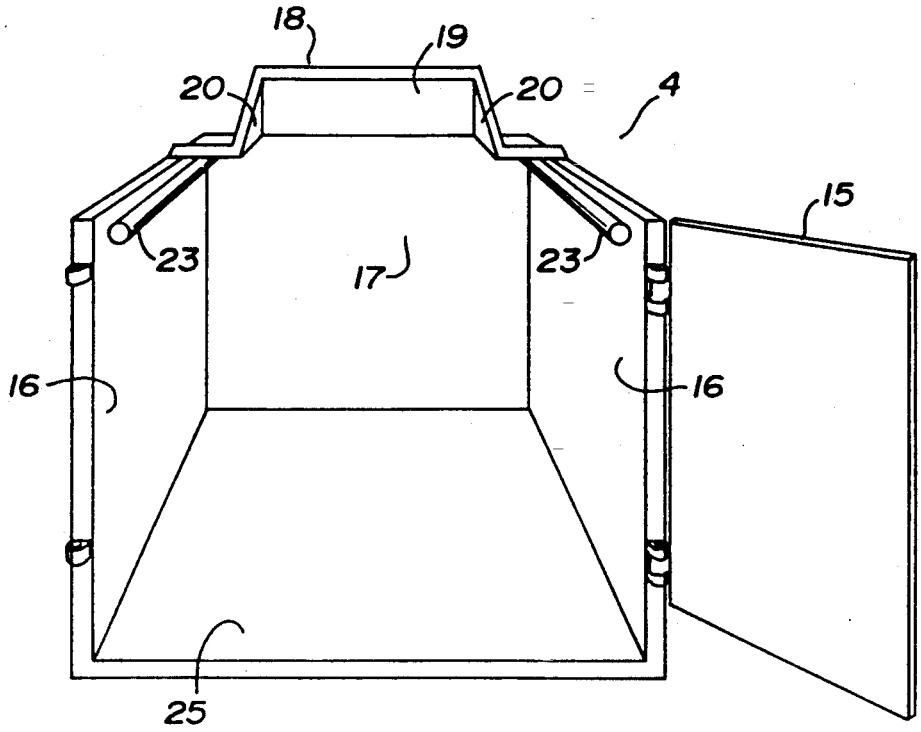
FIG. 12 is a front view showing the box with the front wall removed.
Figure 13:
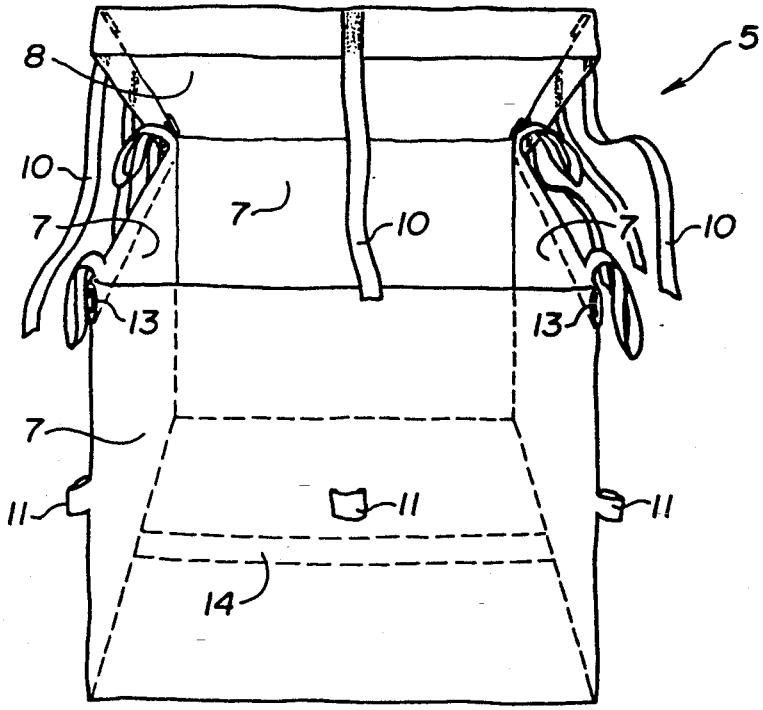
FIG. 13 is a front view showing the bag erect and open.
Figure 14:
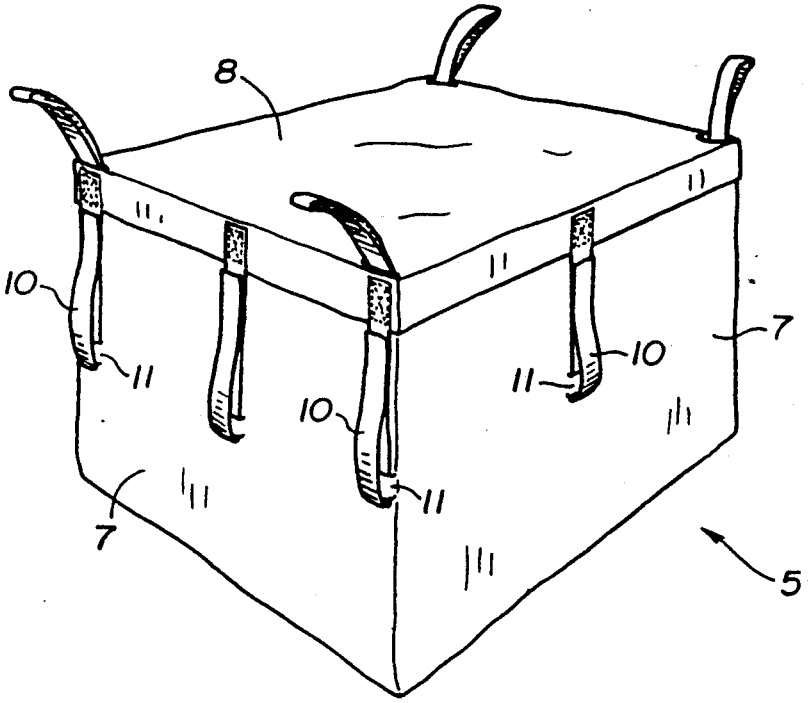
FIG. 14 is a front view showing the bag closed.
Figure 15A:
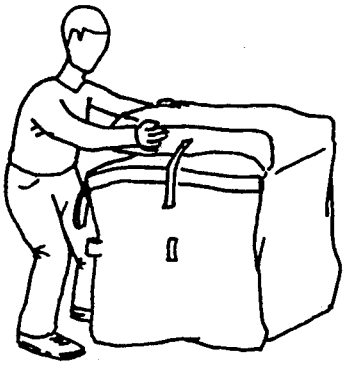
FIGS. 15(*a*)-15(*h*) are a series of simplified views showing.
Figure 15B:
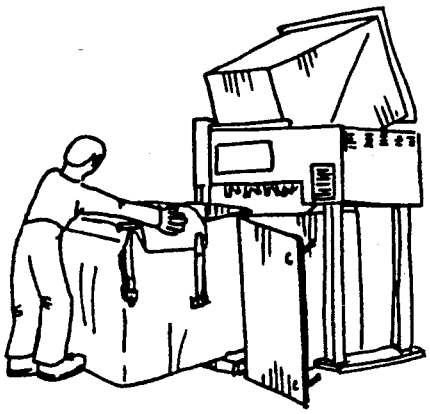
Figure 15C:
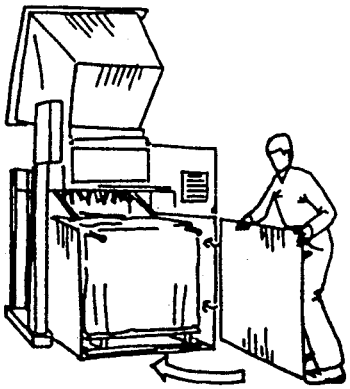
Figure 15D:
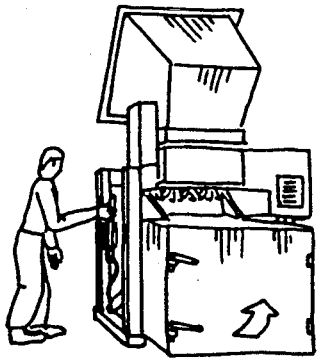
Figure 15E:
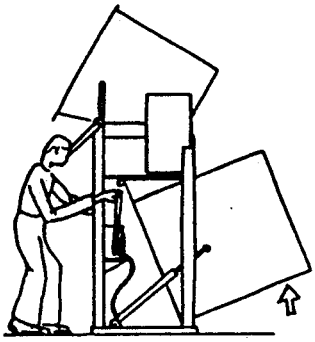
Figure 15F:
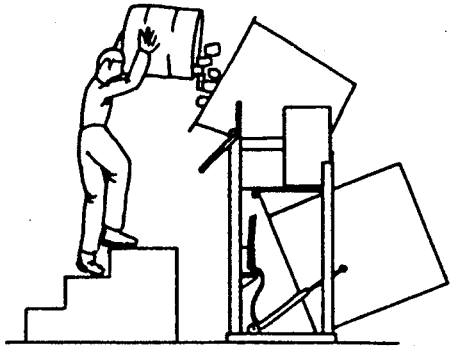
Figure 15G:
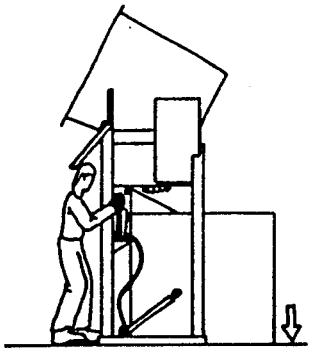
Figure 15H:
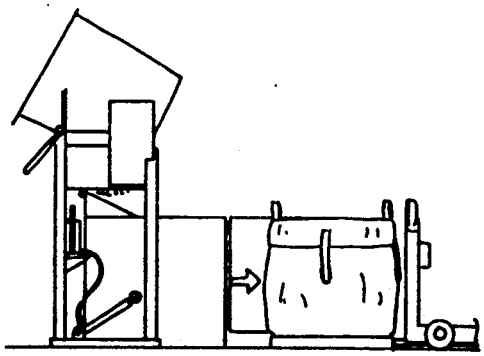
Figure 16:
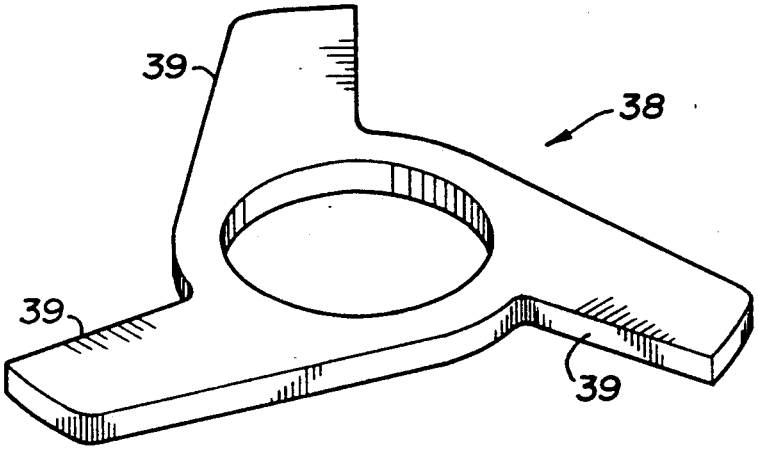
FIG. 16 is a perspective view showing a set of teeth for mounting on the shaft of the rotor.

In general, the assembly 1 comprises:

a shredder/compactor 2 for shredding and compacting waste material 3;
a steel box 4 for confining and supporting a bag 5 which is to be loaded with shredded waste material;
a fork lift-type pallet 6 for supporting the bag 5; and
the bag 5 being suspended in an opened erect condition in the box 4.

More particularly, the bag 5 is generally rectangular and box-like in configuration and forms an interior chamber. It is formed of strong flexible material, such as woven polypropylene, so that it is collapsible and foldable into a compact bundle. It is sized to have a close fit in the box 4. As shown, the bag 5 is comprised of integral bottom and side walls 7 and a top wall 8 that is secured at its rear end to the rear wall 7, but is otherwise separate. The top wall 8 is further provided with straps 10 that can be secured to loops 11 provided on the bag side walls 7. Thus the top wall 8 can be closed and secured to the side walls 7 but it can also be partially peeled back as required to provide an opening 12 into which the shredded waste material can be fed. The closed portion of the top wall 8 is operative to contain the shredded material being compacted into the interior chamber of the bag 5 and prevent the overflow or escape of the material. Along their upper edges, the side walls 7 carry loops 13 for suspending the bag 5, as described below. Across its undersurface, the bag 5 has a loop 14 for use by a fork-lift to hold the bag suspended upside down to empty it.

Turning now to the open-topped box 4, its front wall 15 is hinged to provide a gate. The wall 15 is thus removable to enable insertion and extraction of the pallet 6 and bag 5. A latch 15*a* is provided to look the wall in the closed position. The side walls 16 of the box diverge outwardly from the rear end wall 17 to the front wall 15—this divergence is desirable to ease extraction of the bulging filled bag 5.

At its rear end, the box 4 has a short triangular extension 18 formed by a rectangular rear wall 19 and triangularly shaped side walls 20. The wall 19 is hingedly connected with the shredder/compactor 2 by a pin and sleeve 14 assembly 21.

The box 4 has a pair of rods 23 extending forwardly from its rear end wall 17 along each side of the box, close to its upper rim. The rods 23 are adapted to cooperate with the bag sleeves 13 to suspend the bag 5 in the box 4 in an erect and opened condition. Tubes 24 are used for threading through the sleeves 13 when the bag 5 is being opened outside the box 4 and then the tubes are slipped over the rods to suspend the bag within the box.

The pallet 6 is formed of wood and is of the type normally used with fork lift-type jacks. As shown, the pallet 6 is positioned in the box 4 beneath the bag 5.

The bag 5 is sized to have a sufficiently close fit with the box 4, when suspended therein in an opened and erect condition, whereby the box will act to rigidly confine and support the bag as it is filled and begins to bulge.

Turning now to the shredder/compactor 2, it basically is the machine disclosed in the Benson patent. However, some novel improvements are disclosed herein.

More particularly, the shredder/compactor comprises an elevated horizontal rectangular frame 28. The frame 28 forms a central tubular member 29 of generally rectangular cross-section. The tubular member 29 forms a vertical throat or passageway 30. A rotor 31 extends across the passageway 30 at its lower end and is rotatably mounted at its ends in a first pair of opposed side walls 32 of the tubular member 29. The rotor 31 is driven by a motor 33 through reduction gear means 34. A claw shaft 35 is also rotatably mounted to the tubular member walls 32 at the upper end of the passageway 30. The claw shaft 35 is also driven by the motor 33 and has hooks 36 which function to withdraw waste material 3 from the hopper 26 and to feed it to the rotor 31.

The rotor 31 itself comprises a shaft 37 carrying spaced apart plates 38, each plate 38 forming three equidistantly spaced apart teeth 39. The teeth 39 project downwardly beyond the lower outlet of the tubular member 29.

The tubular member anvil wall 27 carries an array of downwardly and inwardly curving anvil members 40, which are spaced apart to mesh with the rotor teeth 39 with a loose clearance.

The tubular member wall 41, which is opposed to the anvil wall 27, carries an array of stripping plates 42 which are spaced to mesh with the rotor teeth 39 with a close clearance.

The anvil wall 27 is pivotally mounted at its upper end to the frame 28. A threaded crank 43 is mounted to and through a downwardly extending outer wall 44 of the frame 28. At its inner end, the crank 43 carries a plate 45. The plate 45 carries steel springs 46 which abut a plate 47 secured to the back of the pivotable anvil wall 27. Thus if a rigid item of waste material gets trapped between the rotor teeth 39 and the anvil members 40, the anvil assembly 48 (comprising wall 27 and members 40) can resiliently pivot rearwardly, to allow the item to pass. In addition, the crank 43 can be retracted to pivot the anvil assembly 48 to an open position to enable the operator to clean out trapped material, between runs with different waste material.

The hopper 26 is box-like in configuration and is mounted at an angle, to present its mouth 49 for feeding from the front. A gate 50 is pivotally mounted within the hopper chamber 51 so as to be rotatable from an open position, resting on the bottom wall 52 of the hopper 26, and a closed position wherein it extends across the width of the hopper chamber 51 but projects upwardly only across part of its height. The gate 50 is useful, when erected, to prevent cardboard boxes and similar "bouncy" items from being ejected from the hopper as a result of contacting the rotating claw shaft 35 or rotor 31.

The frame 28 is supported in an elevated position by corner leg assembly 53.

Hydraulically actuated cylinders 54 pivotally connect the leg assembly 53 with the box side walls 16. The cylinders can be extended to pivot the box 4 up to the raised loading position and to retain it looked there during filling.

In operation, a pallet 6 is inserted in the box 4. The bag 5 is suspended from the box rods 23 in an open erect condition and resting on the pallet. The top wall 8 of the bag 5 is partly peeled back to provide an opening 12 for registering with the bottom outlet of the passageway 30. The cylinders 54 are extended to raise and pivot the box 4 and bring the triangular extension 18 into sealing engagement with the underside of the frame 28. Waste material is then withdrawn from the hopper 26 by the claw shaft 35 and shredded by the shredder/compactor 2 in the usual way and packed into the bag 5. When the bag 5 is fully packed, the box wall 15 is removed or opened and a fork lift jack can be used to extract the bag 5 and pallet 6 as a unit ready for shipping.

The scope of the invention is defined by the claims now following.

What is claimed is:

1. An assembly for shredding waste material and packing it in the form of a palletized bagged unit ready for shipping, comprising:

a shredder-compactor means comprising a hopper, a frame supporting the hopper, a generally rectangular, downwardly extending tubular member formed by the frame and being adapted to receive waste material from the hopper, said tubular member forming an open-ended passageway having an upper inlet and lower outlet, means for supporting the frame in an elevated position whereby receptacle means may be positioned beneath the bottom outlet of the tubular member, a driven rotatable rotor comprising a shaft carrying outwardly projecting, spaced apart teeth, said rotor extending transversely across the passageway and being mounted to a pair of first opposed side walls of the tubular member, said teeth being adapted to project downwardly beyond the lower outlet of the tubular member in the course of rotation, said tubular member carrying opposed spaced-apart anvil members and spaced-apart stripping members on the second opposed side walls of the tubular member, said anvil members and stripping members being adapted to mesh with and enable passage of the rotor teeth therebetween, said teeth and anvil members being operative in the course of downward rotation of the teeth to withdraw waste material out of the hopper, to shred it and to bias it into the receptacle means, said stripping members being operative to strip residual shredded material clinging to the teeth as they rotate upwardly therethrough, said teeth further being operative to compact the shredded material in the receptacle means, as the latter becomes filled, in the course of rotating beneath the lower outlet of the tubular member; and receptacle means associated with the shredder-compactor means, said receptacle means comprising a rigid open-topped box having bottom and side walls and front and rear end walls, the front end wall being removable, said walls being essentially non-apertured, said box being pivotally connected adjacent its upper rear end with the frame-support means, linearly extendable and retractable means for raising and pivoting the box into a loading position wherein the base of the box may be angularly positioned relative to horizontal so as to be generally perpendicular to the direction of travel of shredded material being fed from the tubular member, said box comprising means for suspending a collapsible foldable flexible replaceable bag, open and erect in the box, said bag having a generally rectangular and box-like configuration and being sized to have a close fit with the box when opened and suspended therein, said bag forming an interior chamber and having a top wall which is partly opened to provide an opening for communicating with the outlet of the tubular member when in the loading position, said bag being supported on a fork-life pallet positioned in the box.

2. The assembly as set forth in claim 1, wherein:

the box has side walls diverging outwardly from rear to front.

3. The assembly as set forth in claim 5 comprising:

the tubular member wall carrying the anvil members being hingedly connected at its upper end to the frame; and means carried on the frame for resisting pivoting movement of the anvil member wall but enabling the wall to pivot if it is pressed against with sufficient force, said means comprising:

a threaded crank mounted to the frame and being adapted to be screwed toward or away from the anvil member wall, a plate carried by the crank at its inner end and transverse to it longitudinal axis, and coil spring means extending between the plate and anvil member wall, whereby the wall may be pivoted against the restraint of the spring means and the crank may be actuated to vary the spacing of the anvil members relative to the rotor.

4. The assembly as set forth in claim 1, wherein:

the hopper is box-like in configuration, has side and rear walls, and is inclined at an acute angle from horizontal to form an upwardly and forwardly directed inlet; and a gate is pivotally mounted inside the hopper chamber between its inlet and rear ends and is movable between an open position, adjacent the bottom side wall of the hopper, and a closed position in which it extends transversely across the chamber and extends part way up to the top side wall of the hopper.

* * * * *